US009080364B2

(12) United States Patent
Vanini

(10) Patent No.: US 9,080,364 B2
(45) Date of Patent: Jul. 14, 2015

(54) DOOR OR WING FOR ELECTRICAL HOUSEHOLD APPLIANCES

(75) Inventor: Angelo Vanini, Bologna (IT)

(73) Assignee: NUOVA STAR S.p.A. (IT)

( * ) Notice: Subject to any disclaimer, the term of this patent is extended or adjusted under 35 U.S.C. 154(b) by 322 days.

(21) Appl. No.: 12/853,960

(22) Filed: Aug. 10, 2010

(65) Prior Publication Data

US 2011/0037364 A1 Feb. 17, 2011

(30) Foreign Application Priority Data

Aug. 13, 2009 (IT) ..... BO2009A0547

(51) Int. Cl.
*E05F 1/12* (2006.01)
*F24C 15/02* (2006.01)

(52) U.S. Cl.
CPC ..... *E05F 1/1261* (2013.01); *F24C 15/023* (2013.01); *E05Y 2900/308* (2013.01)

(58) Field of Classification Search
CPC ..... E05D 11/10; E05D 3/06; E05F 1/1261; E05F 1/12; E05F 1/1246; E05F 1/1253; F24C 15/023
USPC ..... 312/319.2, 327, 328; 16/277, 286, 287, 16/288
See application file for complete search history.

(56) References Cited

U.S. PATENT DOCUMENTS

| | | | | |
|---|---|---|---|---|
| 3,018,509 | A * | 1/1962 | Sherman | 16/232 |
| 7,610,656 | B2 * | 11/2009 | Vanini | 16/286 |
| 7,676,888 | B2 * | 3/2010 | Vanini | 16/286 |
| 7,765,643 | B2 * | 8/2010 | Vanini | 16/286 |
| 8,286,306 | B2 * | 10/2012 | Vanini | 16/290 |
| 2003/0056328 | A1 * | 3/2003 | Habegger et al. | 16/343 |
| 2006/0053589 | A1 * | 3/2006 | Vanini | 16/286 |
| 2007/0232135 | A1 | 10/2007 | Vanini | |
| 2007/0283532 | A1 * | 12/2007 | Vanini | 16/277 |

FOREIGN PATENT DOCUMENTS

| | | | | |
|---|---|---|---|---|
| EP | 632180 | A1 * | 1/1995 | E05F 1/12 |
| EP | 1847670 | A2 * | 10/2007 | |
| EP | 1961901 | | 8/2008 | |
| EP | 1961901 | A2 * | 8/2008 | F24C 15/02 |

OTHER PUBLICATIONS

European Search Report dated Mar. 29, 2010 from corresponding Italian application.

* cited by examiner

*Primary Examiner* — Emily Morgan
(74) *Attorney, Agent, or Firm* — Timothy J. Klima; Shuttleworth & Ingersoll, PLC

(57) ABSTRACT

A door or wing for electrical household appliances comprises a pivoting element (30) and two hinges (40, 50) mounted along one perimetric side of the pivoting element (30) to join the pivoting element (30) to a frame (2) and make it movable relative to the latter between a closed position and an open position, each of the two hinges (40, 50) comprising a first member and a second, box-shaped member and a lever for connecting the first and second members.

8 Claims, 6 Drawing Sheets

DOOR OR WING FOR ELECTRICAL HOUSEHOLD APPLIANCES

This application claims priority to Italian Patent Application BO2009A000547 filed Aug. 13, 2009, the entirety of which is incorporated by reference herein.

BACKGROUND OF THE INVENTION

This invention relates to a door or wing for electrical household appliances.

More specifically, this invention has for its subject-matter a door or wing connected to the respective mounting structure of an electrical household appliance such as an oven.

This specification describes this invention with reference to an oven purely by way of example and without restricting the scope of the inventive concept.

Prior art doors or wings comprise two hinges used to connect them to the structure of an oven or other electrical household appliance.

The hinges normally consist of two separate parts kinematically linked to each other, either directly or through an interposed lever.

More specifically, the first part is fixed to the oven structure on one side of the oven opening, whilst the second part is fixed to one edge of the oven door which can thus be tilt opened with respect to the opening.

One or more elastic elements are interposed between the two hinge parts.

When the oven door is tilted away from the closed position, the elastic elements first oppose the movement which detaches the door from the oven mounting frame and then, instead, they oppose the subsequent rotational movement of the door and its consequent lowering to the position in which the access opening of the oven is fully open.

During the second part of its opening movement, the door, under the combined action of its weight, which tends to pull it downwards, and of the elastic elements, which oppose this downward pulling action, is thus made to turn gradually.

One of the most complex and time-consuming, and hence cost-intensive, steps in the assembly of a hinge is that of inserting into one of its components the elastic elements described above which must be mounted in a preloaded condition if they are to operate effectively.

SUMMARY OF THE INVENTION

This invention therefore has for an aim to reduce the difficulty and costs connected with the above mentioned hinge assembly operations, while still providing a door or wing with good operating efficiency.

This invention accordingly provides a door or wing comprising the features described herein.

The technical features of the invention according to the aforementioned aim may be easily inferred from the contents of this description.

BRIEF DESCRIPTION OF THE DRAWINGS

Further, the advantages of the invention are apparent from the detailed description which follows, with reference to the accompanying drawings, which illustrate a preferred, non-limiting example embodiment of it and in which.

DESCRIPTION OF THE PREFERRED EMBODIMENTS

Figure 1:
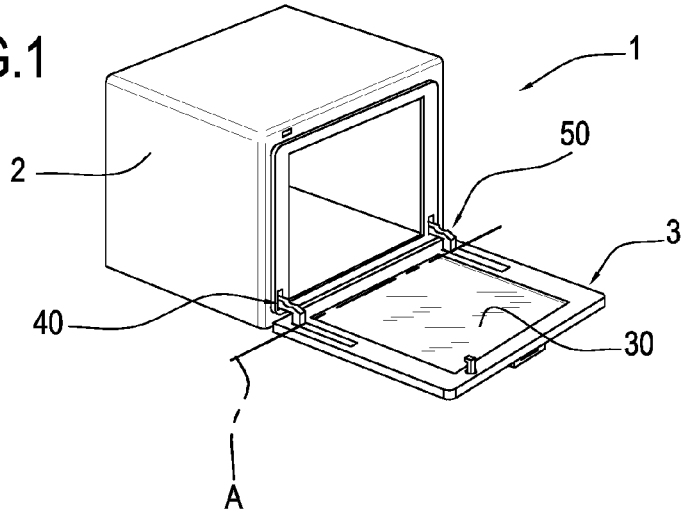
FIG. 1 is a schematic perspective view from above of an oven with a door made in accordance with this invention.

The numeral 1 in FIG. 1 denotes in its entirety an oven comprising a frame 2 to which a door 3 is connected.

The door 3 comprises a pivoting element 30 and two hinges 40, 50 by which the pivoting element 30 can be tilted about a horizontal axis A.

Figure 2:
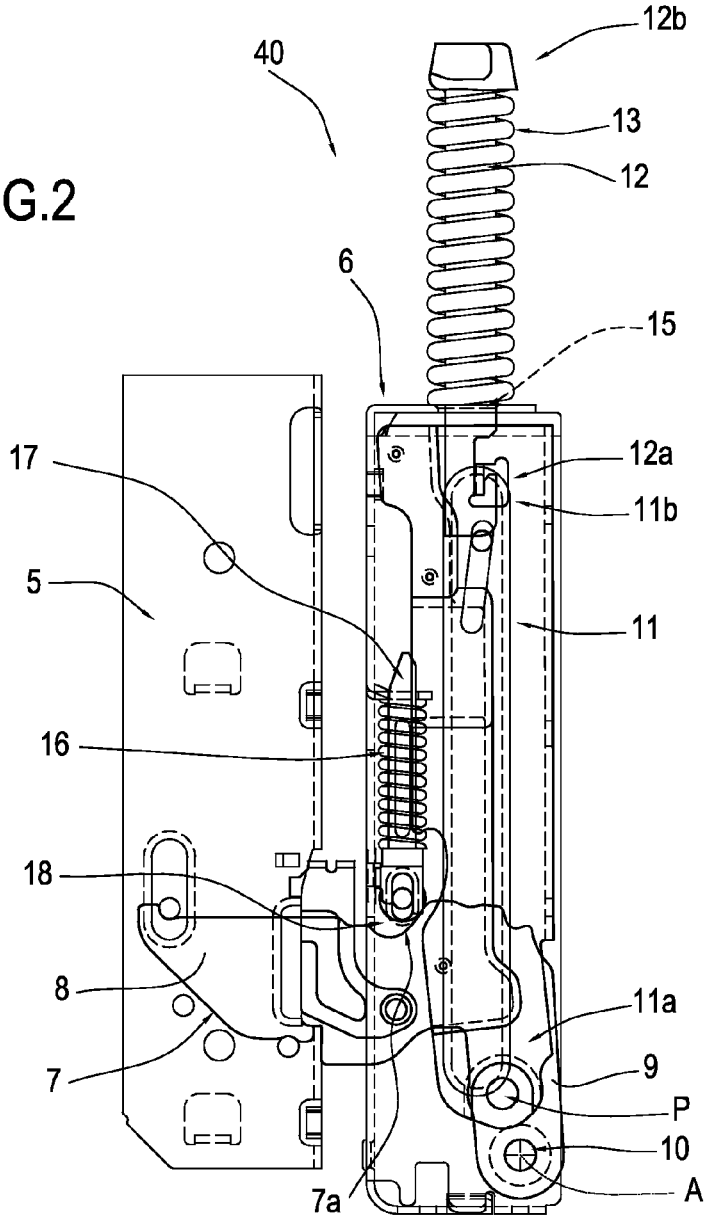
FIGS. 2 to 4 and 8 are schematic side elevation views, with some parts cut away or transparent in order to better illustrate others, of a first hinge for the door according to the invention in three different operating configurations.
Figure 3:
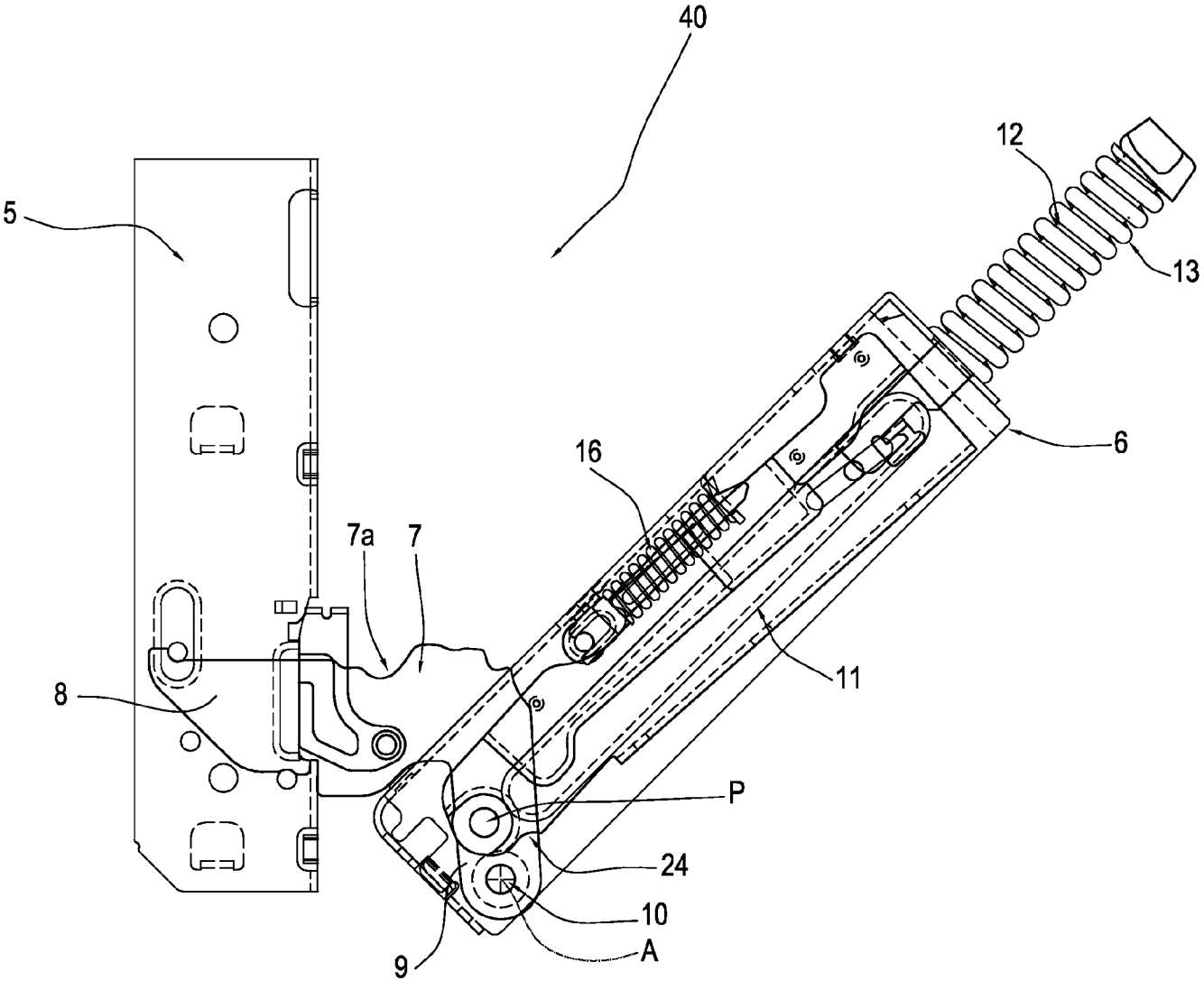
Figure 4:
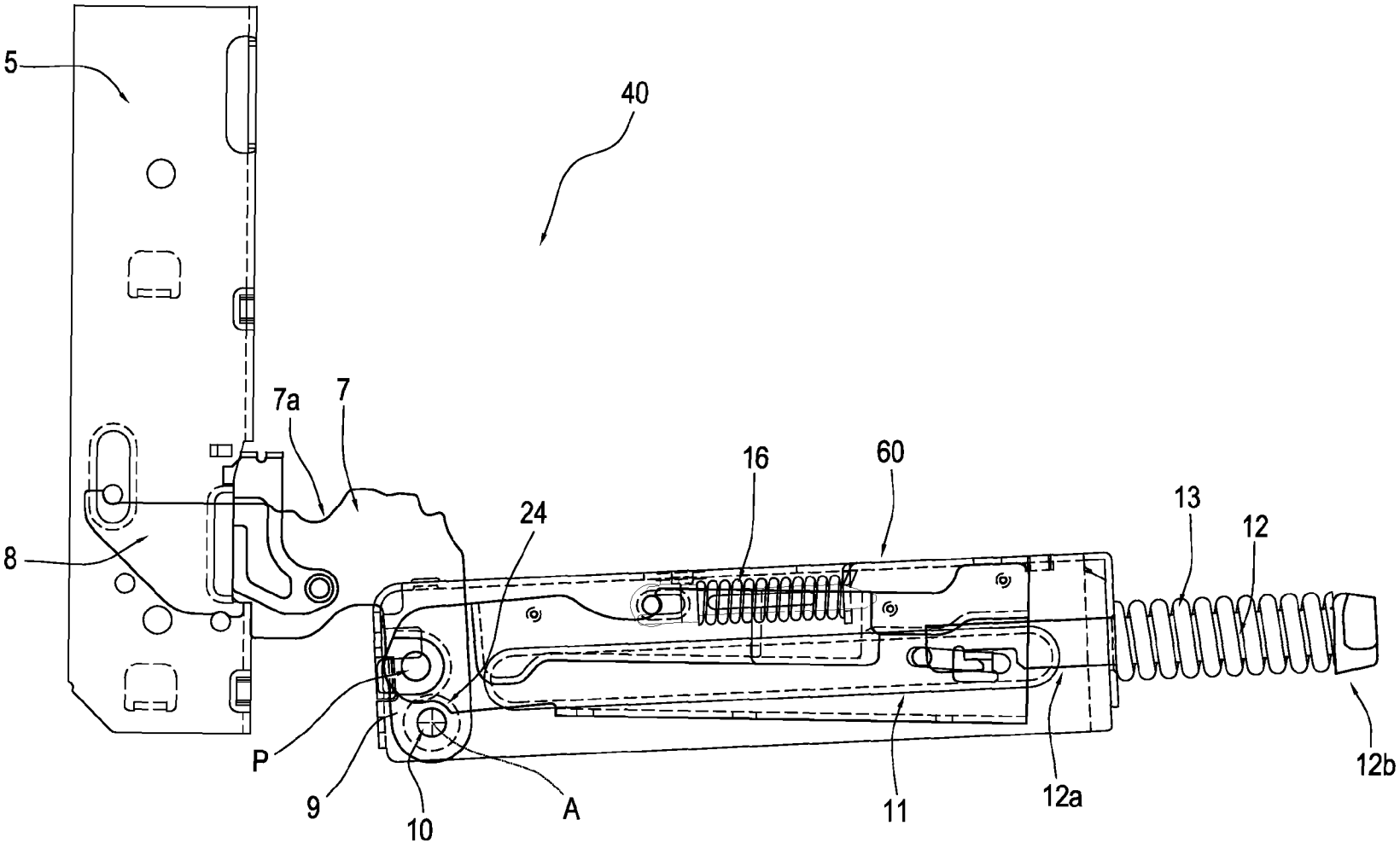

With reference to FIGS. 2 to 4, the hinge 40, of substantially known type, comprises a first box-shaped member 5 fixed to the frame 2 of the oven 1, and a second member 6, also box-shaped, fixed to the door 3. The first and second box-shaped members 5, 6 are kinematically connected by a connecting lever 7.

The connecting lever 7 comprises a first arm 8, designed to be rigidly connected to the first box-shaped member 5, and a second arm 9 connected to the second box-shaped member 6.

For connecting the second arm 9 and the second box-shaped member 6 to each other, the hinge 40 comprises a first pin 10 passing through a respective hole made in the end of the second arm 9 itself and being coaxial with the axis A.

The hinge 40 also comprises a link rod 11 and a stem 12 located one after the other longitudinally partly inside the second box-shaped member 6 and hooked to each other.

Advantageously, the link rod 11 is box shaped, with a C-shaped cross section, and has a second or lower end 11 a pivoted to the lever 7 at a respective pin P and a first or an-upper end 11*b* for connection to a lower end 12*a* of the stem 12.

The second box-shaped member 6 houses a first helical spring 13 (primary elastic opposition mechanism), fitted round the outside of the stem 12 and stressed by compression.

At an upper end of the second box-shaped member 6 there is a hole 15 which the stem 12 passes through; the edges of the hole 15 forming an abutment surface for a proximal end coil of the spring 13.

The stem 12 has an upper end 12*b* longitudinally opposite the end 12*a* that is hooked to the link rod 11, the upper end 12*b* being designed to engage a distal end coil of the spring 13 in such a way as to compress the spring 13.

The spring 13 constitutes for the hinge 40 elastic means designed to generate a reaction force that opposes the opening movement of the door 3 from the closed position to the fully open position.

Figure 8:
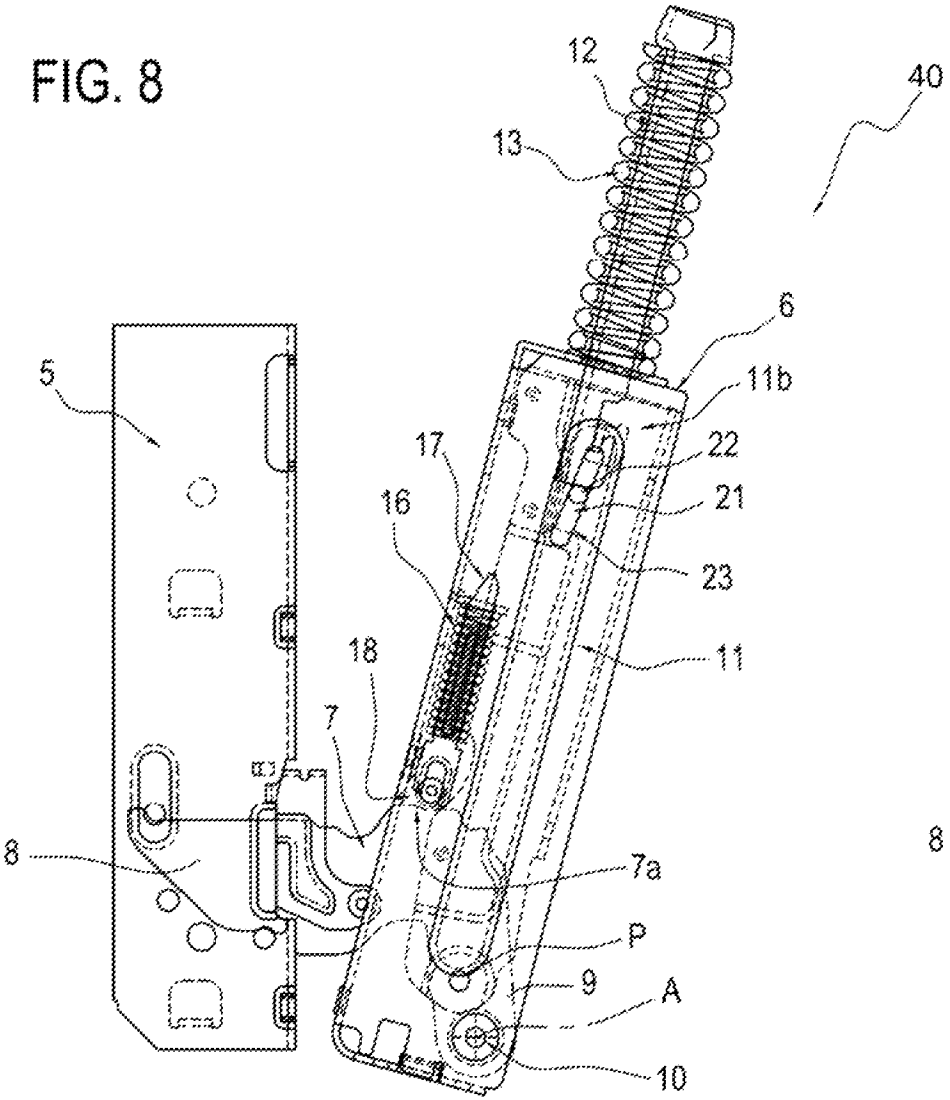

Added to the elastic action of the spring 13, only in the proximity of the closed position, towards and away from the closed position, is the action of a second, pre-compressed helical spring 16, designed to act in conjunction with a cam 7*a* formed on the rocker lever 7 through a respective stem 17 which operates on a roller tappet 18, to impart a spring action closing movement to the door 3 (see FIG. 2) and to define a stable partial-open position for the latter (see FIG. 8).

The structural and functional features of the second spring 16 are described in Italian patent application BO2006A000308, which is filed in the name of the same applicant as that of this invention and which is incorporated herein by reference, and are not further described in this specification.

Figure 6:
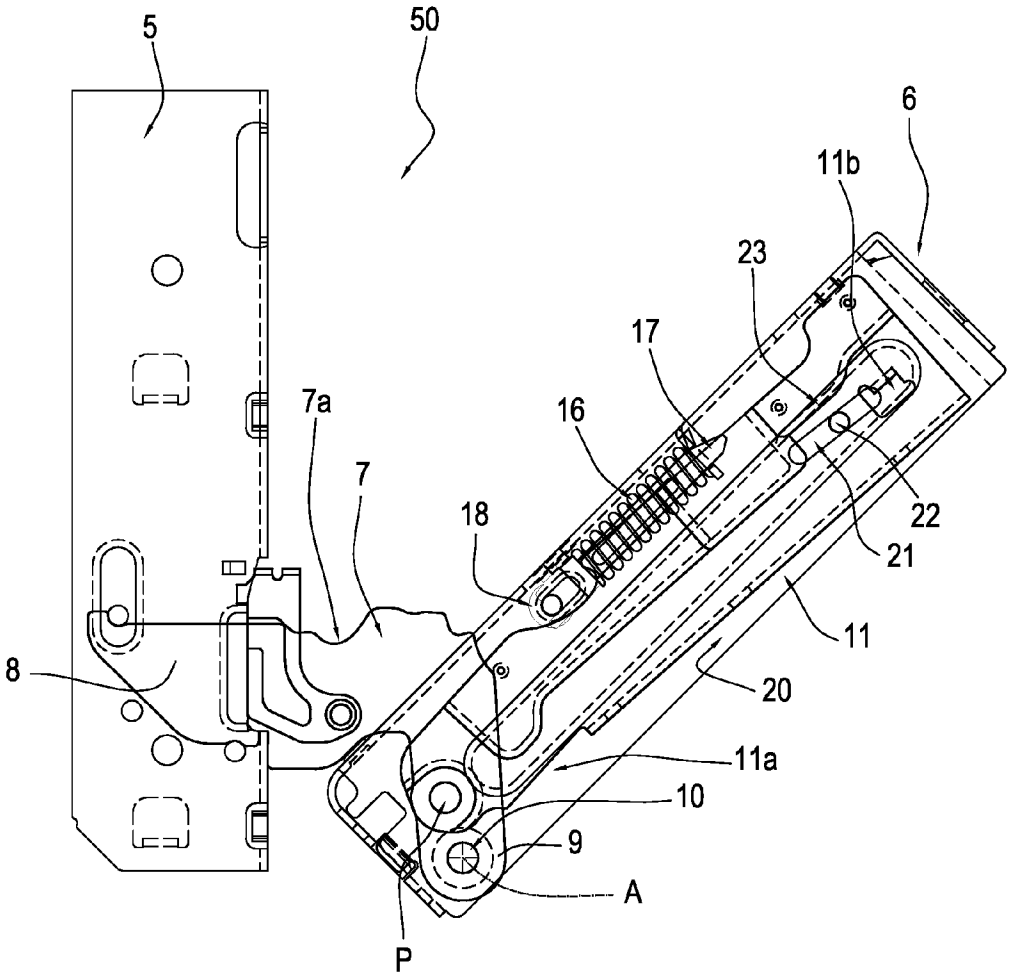
FIGS. 5 to 7 and 9 are schematic side elevation views, with some parts cut away or transparent in order to better illustrate others, of a second hinge for the door according to the invention in three different operating configurations.
Figure 5:
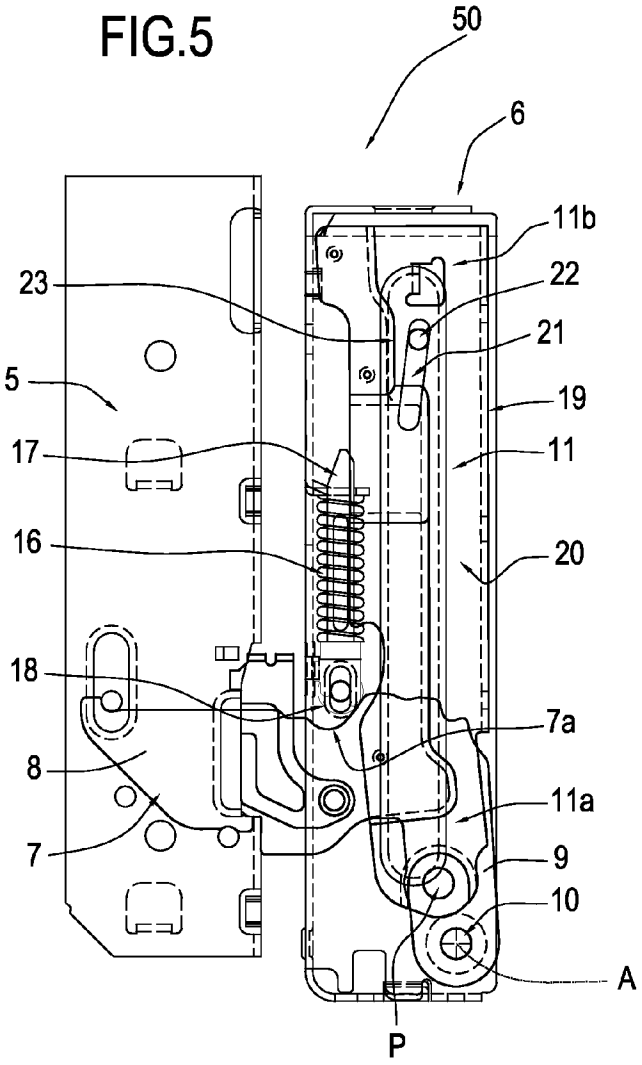
Figure 7:
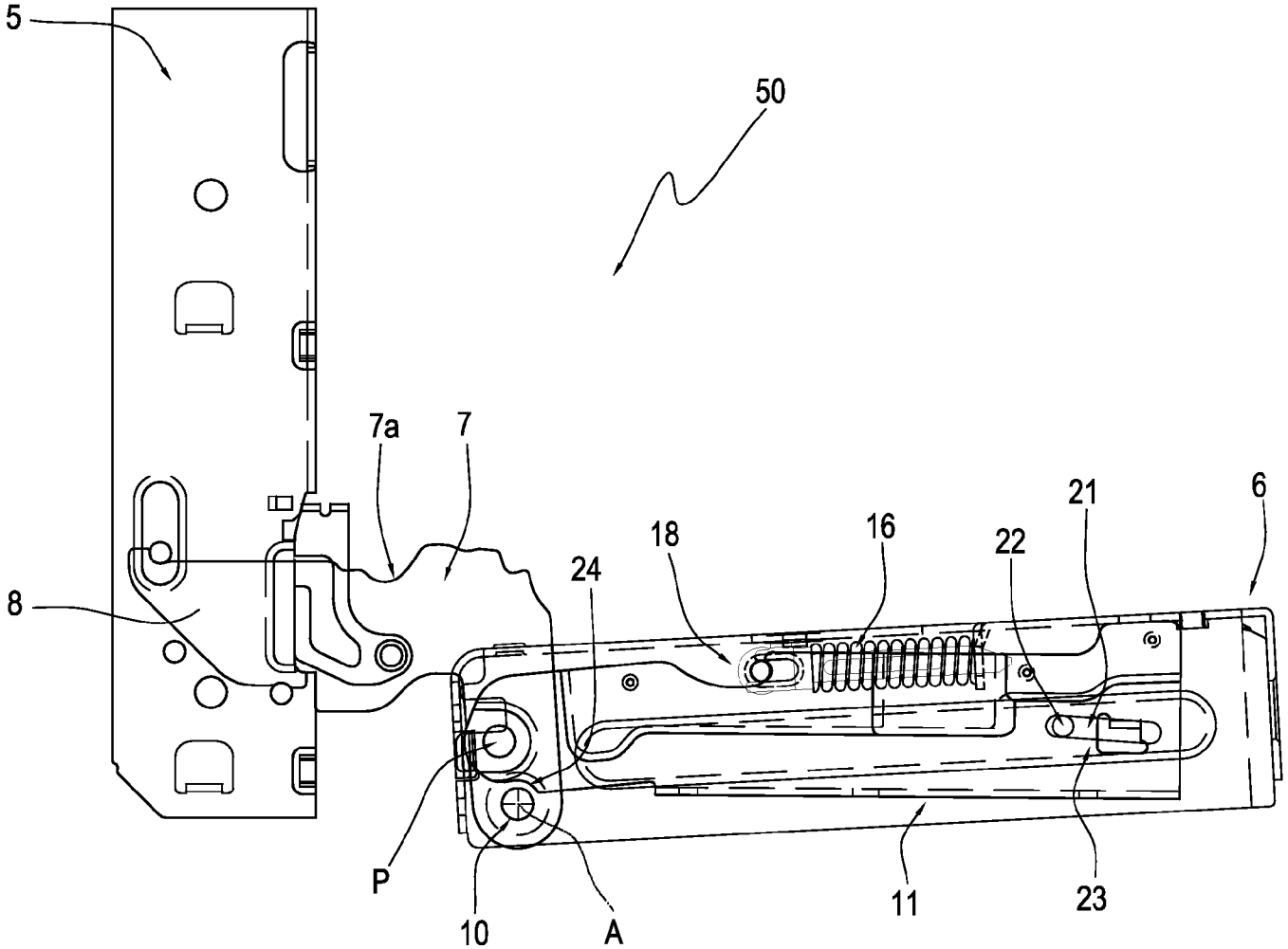

With reference to FIGS. 5 to 7, the hinge 50 comprises a first box-shaped member 5 fixed to the frame 2 of the oven 1, and a second member 6, also box-shaped, fixed to the door 3. The first and second box-shaped members 5, 6 are kinematically connected by a connecting lever 7.

The connecting lever 7 comprises a first arm 8, designed to be rigidly connected to the first box-shaped member 5, and a second arm 9 connected to the second box-shaped member 6.

For connecting the second arm 9 and the second box-shaped member 6 to each other, the hinge 50 comprises a first pin 10 passing through a respective hole made in the end of the second arm 9 itself and being coaxial with the axis A.

The hinge 50 also comprises a link rod 11 located inside the second box-shaped member 6.

Advantageously, the rod 11 is also box shaped, with a C-shaped cross section, and has a lower end 11*a*, which is pivoted to the lever 7 at a respective pin P, in substantially known manner, and an upper end 11*b*.

Unlike the hinge 40, the second box-shaped member 6 of the hinge 50 does not house a helical spring constituting elastic means designed to generate a reaction force that opposes the opening movement of the door 3.

Instead, the second box-shaped member 6 of the hinge 50 houses a spring 16 which operates only in the vicinity of the door 3 closed position, towards and away from the closed position itself.

Figure 9:
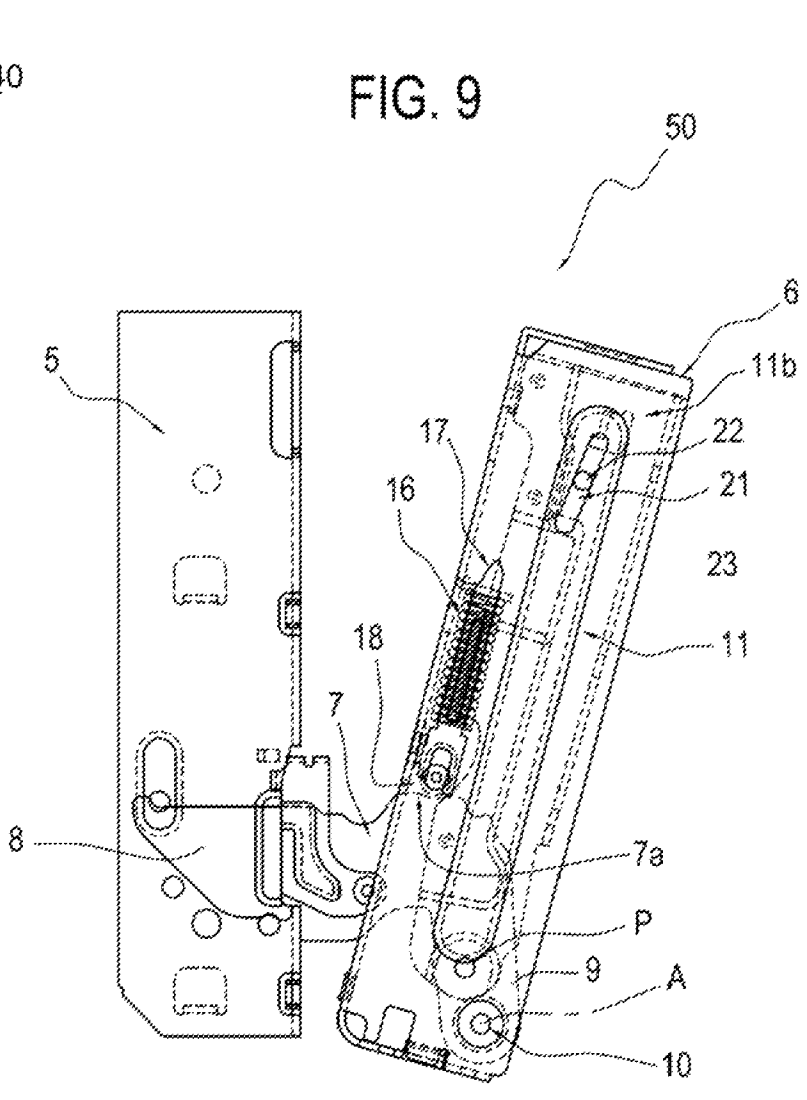

The spring 16, acting in conjunction with a cam 7*a* formed on the rocker lever 7 through a respective stem 17 which operates on a roller tappet 18, is designed to impart a spring action closing movement to the door 3 (see FIG. 5) and to define a stable partial -open position for the latter (see FIG. 9).

As mentioned above with reference to the hinge 40, the structural and functional features of the spring 16 are described in Italian patent application BO2006A000308, which is filed in the name of the same applicant as that of this invention and which is incorporated herein by reference.

The C box-shaped link rod 11 comprises a front wall 19 and two parallel lateral walls 20, only one of which is shown in the accompanying drawings. At the upper end 11b of the link rod 11, each of the two lateral walls 20 has a slot or slot-like opening 21 inside which a pin 22 made as one with the walls of the second box-shaped member 6 is slidably engaged.

The openings 21 and the pin 22 together form a mechanism or means 23 for guiding the link rod 11 relative to the second, box-shaped member 6 in such a way as to keep the two components of the hinge 50 in the correct position as they move relative to each other.

As clearly shown in FIG. 6, at the pivot P between the link rod 11 and the connecting member 7, the link rod 11 has a curved portion 24 designed to abut the pin 10 to provide a limit stop, that is to say, a fully open position between the first member 5 and the second member 6 (FIG. 7), as well as a fully open position for the door 3.

More in detail, in the preferred, box-shaped embodiment of the link rod 11, there are in fact two curved portions 24, one for each of the facing lateral walls of the link rod 11 itself.

The curved portions 24 of the link rod 11 and the pin 10 together form respective limit stop means for the hinge 50.

In use, as illustrated in FIG. 1, the wing or door 3 according to this invention comprises a hinge 40 and a hinge 50 mounted at opposite ends of the lower edge of the pivoting element 30.

The use of the hinge 50 without elastic means simplifies the overall assembly of the door 3 since the time-consuming steps of preloading and inserting the spring in the second box-shaped member 6 are necessary only for the spring 13 in the hinge 40.

Thanks to the curved portions 24 formed on the link rod 11, the hinge 50 can guarantee an effective limit-stop action even in the absence of elastic means, thus making it possible to comply with safety regulations regarding the door 3 and the electrical household appliance 1 as a whole.

Further, in order to obtain advantageous economies of scale, the structure of the hinges 40 and 50 is basically the same, the limit stop means being conveniently built into the link rod 11.

The link rod 11, necessary for the correct operation of the hinge 40, could have been eliminated from the hinge 50 but, precisely to obtain economies of scale, it was maintained and, instead, suitable guide means 23 were provided for the purpose of guaranteeing the correct relative movement between the link rod 11 and the second box-shaped member 6.

Advantageously, for the same reason, the limit stop means, constituted by the curved portion 24 on the link rod 11 and the pin 10, are also provided on the hinge 40 which does have the elastic means.

For the purposes of this invention, therefore, the expression "hinge without elastic means" means a hinge that does not have elastic means operating substantially during the entire door opening movement as does the spring 13 but not, for example, the spring 16, which is present in both the hinges 40 and 50 but operates solely and exclusively at the start of the door opening movement.

With reference to the accompanying drawings, FIGS. 2 and 5 illustrate the hinges 40 and 50, respectively, in their closed condition corresponding to the door 3 closed condition; FIGS. 8 and 9 illustrate the hinges 40 and 50, respectively, in their partial-open condition; FIGS. 3 and 6 illustrate the hinges 40 and 50, respectively, in their half-open condition, while FIGS. 4 and 7 illustrate the hinges 40 and 50, respectively, in their fully open condition corresponding to the fully open condition of the door 3.

In FIGS. 4 and 7, for clarity of illustration, a gap is shown between the curved portion 24 of the link rod and the pin 10 but in actual fact these parts are in abutment against each other in order to create the limit stop condition.

The invention described has evident industrial applications and can be subject to modifications and variations without thereby departing from the scope of the inventive concept. All the details of the invention may be substituted by technically equivalent elements.

What is claimed is:

1. A door or wing for an electrical household appliance, comprising:

a pivoting element and first and second hinges respectively mounted along opposite perimetric sides of the pivoting element to join the pivoting element to a frame and make it movable relative to the frame, each of the first and second hinges comprising:

a first box-shaped member and a second box-shaped member, a connecting lever connecting the first and second box-shaped members, the connecting lever being pivoted to the second member by a pivot pin making the first and second box-shaped members pivotable relative to each other between a closed position and an open position one chosen from the first and the second box-shaped members attachable to the frame and the other of the first and the second box-shaped members attachable to the pivoting element;

a link rod mounted on the second box-shaped member and having a first end and an opposite second end, the second end pivoted on the connecting lever, the link rod having curved portions capable of creating an effective limit-stop action;

the first hinge comprising a primary elastic opposition mechanism, operatively mounted between the second box-shaped member and the link rod to bias the link rod with respect to the second box-shaped member and opposing an opening movement of the pivoting element through an entire range between the closed position and the open position, the second hinge having a structure similar to the first hinge, but without a primary opposition mechanism or other opposing mechanism connected to the link rod such that movement of the first end of the second hinge link rod is unopposed.

2. The door or wing according to claim 1, wherein each of the first and second hinges comprises a limit stop mechanism for determining a position of maximum angular opening of the second box-shaped member relative to the first member.

3. The door or wing according to claim 2, wherein the limit stop mechanism comprises a portion of the link rod for engaging the pivot pin.

4. The door or wing according to claim 1, wherein each of the first and second hinges comprises a mechanism for guiding the link rod relative to the second box-shaped member, the mechanism for guiding including a first structure on the link rod engaging a corresponding second structure on the second box-shaped member, one chosen from the first structure and the second structure defining a path for engaging the other of the first structure and the second structure, and along which path the other of the first structure and the second structure moves and an extent of the movement is limited.

5. The door or wing according to claim 1, wherein each of the first and second hinges comprises a mechanism for guiding the link rod relative to the second box-shaped member, the mechanism for guiding comprising a guide pin integral with one chosen from the link rod and the second box-shaped member, and at least one slot made on the other of the link rod and the second box-shaped member.

6. An electrical household appliance comprising a door or wing according to claim 1.

7. The door or wing according to claim 4, each of the first and second hinges comprising a pre-compressed helical spring acting when the pivoting element is in a proximity of the closed position, towards and away from the closed position, the helical spring engaging and acting in conjunction with a cam formed on the connecting lever through a stem operating on a roller tappet to impart a spring-action closing movement to the pivoting element when the pivoting element is in the proximity of the closed position and also to define a stable partial-open position for the pivoting element.

8. The door or wing according to claim 5, each of the first and second hinges comprising a pre-compressed helical spring acting when the pivoting element is in a proximity of the closed position, towards and away from the closed position, the helical spring engaging and acting In conjunction with a cam formed on the connecting lever through a stem operating on a roller tappet to impart a spring-action closing movement to the pivoting element when the pivoting element is in the proximity of the closed position and also to define a stable partial-open position for the pivoting element.

* * * * *